United States Patent [19]

Delk, III

[11] Patent Number: 4,722,320

[45] Date of Patent: Feb. 2, 1988

[54] CUTTING SEGMENT FOR CIRCULAR CUTTING WHEEL

[75] Inventor: Thomas E. Delk, III, Lugoff, S.C.

[73] Assignee: Wheel Trueing Tool Company, Columbia, S.C.

[21] Appl. No.: 924,051

[22] Filed: Oct. 28, 1986

[51] Int. Cl.[4] ..... B28D 1/04

[52] U.S. Cl. ..... 125/15; 51/206 R

[58] Field of Search ..... 125/15, 18; 51/206 R, 51/206.4

[56] References Cited

U.S. PATENT DOCUMENTS

| | | | |
|---|---|---|---|
| Re. 25,434 | 8/1968 | Christensen . | |
| 1,163,356 | 12/1915 | Meyers . | |
| 2,826,878 | 3/1958 | Lindblad | 125/15 |
| 3,203,774 | 8/1965 | Pratt | 51/206 R |
| 3,830,020 | 8/1974 | Gomi . | |
| 4,267,814 | 5/1981 | Benson et al. . | |
| 4,505,251 | 3/1985 | Stoll | 125/15 |

FOREIGN PATENT DOCUMENTS

| | | | |
|---|---|---|---|
| 557223 | 5/1957 | Belgium | 125/15 |

*Primary Examiner*—Harold D. Whitehead

*Attorney, Agent, or Firm*—Bell, Seltzer, Park and Gibson

[57] ABSTRACT

A cutting segment adapted for mounting on a circular cutting wheel is disclosed, and which is characterized by its ability to provide a grooved cutting surface that accurately guides the circular wheel to which it is attached through stone, concrete or the like. The cutting segment includes a unitary solid metallic body that has a top wall which defines a cutting surface, a bottom wall opposite the cutting surface, two opposite flat side walls and two opposite end walls. At least one of the end walls includes a recessed channel which extends between and intersects the cutting surface and the bottom wall. The channel defines a central portion on the cutting surface that is contiguous with the intersection of the channel, and two flanking portions on opposite sides of the central portion. In use, greater wear occurs on the central portion of the cutting surface than the flanking portions, resulting in the formation of an arcuate groove extending longitudinally along the cutting surface that guides the cutting wheel through the stone, concrete or the like.

6 Claims, 8 Drawing Figures

BEFORE WEARING

AFTER WEARING

CUTTING SEGMENT FOR CIRCULAR CUTTING WHEEL

BACKGROUND OF THE INVENTION

This invention relates to a cutting segment of the type adapted to be mounted on the periphery of a circular metal disc to form a circular cutting wheel having an outer cutting surface adapted for cutting stone, concrete and the like.

It is common practice to mount a plurality of cutting segments to the periphery of a circular steel disc to form a circular cutting wheel, that is then rotated and translated through concrete or stone in order to cut the concrete or stone. The cutting segments typically consist of solid bodies of diamond dust or diamond fragments used as an abrasive and held dispersed and embedded in metal. Often, the cutting segments are manufactured by cold pressing powdered metal containing diamond dust or diamond fragments into the desired shape and then further pressing this intermediate shape at high temperature and pressure to harden the segment. Segments prepared in this manner, or any other suitable manner, are secured to the periphery of a circular metal disc by welding, brazing or silver soldering. Cutting wheels thus made are then mounted to various types of mobile and stationary saws for use in cutting, among other things, stone, concrete, tile and refractory products.

In cutting materials of the described type, it is important to maintain a straight or true cut. Such a cut reduces the frictional wear on the cutting segments and helps ensure that the wear that does occur is even. Additionally, a straight cut reduces the number of subsequent steps required to prepare the workpiece for its ultimate use and helps prevent chipping that might otherwise occur at the edge of the cut. Further, it facilitates efficient cutting and optimizes the use of the cutting machinery.

To provide a straight cut, it is known in the art that each cutting segment can be constructed so that differential wearing occurs during use on different portions of the cutting surface so that a concave edge or arcuate groove results. As one continues to cut the stone or concrete, this groove wears a similar profile of opposite orientation in the workpiece. The arcuate groove formed in each segment nests with the profile of opposite orientation worn in the workpiece so as to create an effect very much like a train wheel on a rail. The profile in the workpiece guides the cutting wheel through the workpiece resulting in the desired straight cut.

Cutting segments of different types that provide a concave edge or arcuate groove in the cutting surface have been suggested in the past, but they all have significant drawbacks. For instance, the cutting segment suggested by U.S. Pat. No. 3,203,774 achieves differential wearing on the cutting surface by providing a segment of layered construction. Two outer side layers are provided which contain an increased content of abrading material which results in more wear over the central layer of the segment. Such a segment is expensive to make due to its layered construction and inevitably leads to defects in manufacturing that can only be detected after the segment is in use. Additionally, it has been shown that segments with a layered construction are not capable of production rates that otherwise might be obtained because the different segments tend to separate under high stress.

SUMMARY OF THE INVENTION

It is an object of the present invention to overcome the disadvantages pointed out above in connection with known cutting segments and to provide a cutting segment of unitary construction that develops an arcuate groove for guiding the cutting wheel through the stone or concrete. More particularly, it is an object of this invention to provide a cutting segment of unitary construction that develops the correct groove because of the geometry of the cutting segment. It is a further object of this invention to provide a cutting segment in which the geometry of the cutting segment can be selectively configured to provide an optimum cut for different types of stone or concrete.

The present invention in its preferred embodiment is comprised of a solid metallic body which includes a top wall comprising a cutting surface, a bottom wall opposite the top wall, two opposite side walls and two opposite end walls. At least one of the end walls includes a recessed channel that intersects the cutting surface and bottom wall. The channel is centered longitudinally in its associated end wall. In a preferred embodiment, a channel is disposed in each of said end walls, and the two channels are aligned with one another so as to form a central portion and two flanking portions on opposite sides of the central portion on the cutting surface. In use, a plurality of the cutting segments are mounted to the periphery of a circular metal disc. Greater wear occurs on the central portion of each cutting surface of each segment than occurs on the flanking portions resulting in the formation of an arcuate groove extending longtiduinally along the central portion that guides the cutting wheel through the stone, concrete or the like and thereby provides a truer cut.

DESCRIPTION OF THE ILLUSTRATED EMBODIMENT

Figure 2:
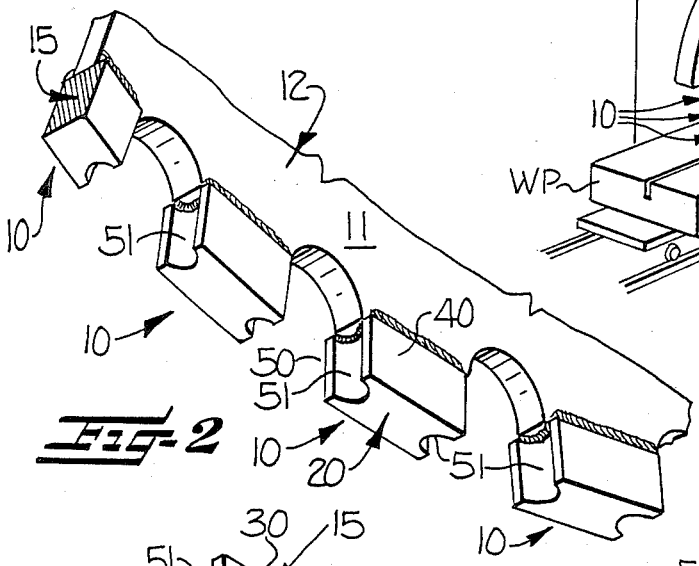
FIG. 2 is a perspective view of the bottom portion of a circular cutting wheel having the present invention mounted thereon and showing the cutting surface of the segments before use.
Figure 1:
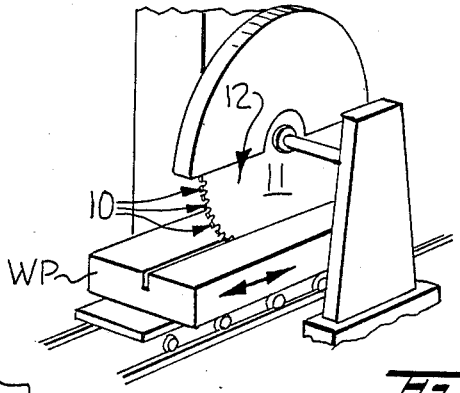
FIG. 1 is an environmental view of a cutting operation showing the present invention mounted to a circular cutting wheel that is in turn mounted to a stone saw.

As seen in FIGS. 1 and 2, a plurality of cutting segments 10 are mounted to a circular metal disc 11 to form a circular cutting wheel 12 that is suitable for cutting stone, concrete, or other similar workpiece WP. The circular cutting wheel 12 is in turn mounted to a stone or concrete saw that sets the cutting wheel in rotation and translates it through the workpiece to effectuate the desired cut. The cutting segments 10 may be commonly mounted to the circular metal disc by welding or with silver solder or braze 13, but those skilled in the art will appreciate that other means of mounting the segment to the disc are possible. The circular metal disc typically ranges in size from one to three meters in diameter.

Figure 3:
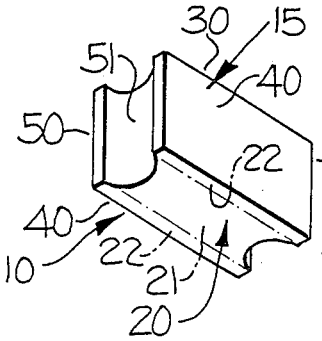
FIG. 3 is a perspective view of the cutting surface of a single cutting segment before any wearing has occurred.

FIG. 3 illustrates a preferred embodiment of the structure of the cutting segment. The cutting segment is comprised of a unitary solid metallic body 15. The unitary construction of the body eliminates the possibility that different layers of the segment will become separated under the stress of cutting and thereby allows the cutting process to proceed at relatively high production rates. The metallic body is made up of any suitable metal, although iron or cobalt is preferred, with diamond dust or diamond particles or some other suitable abrasive evenly dispersed throughout the metal. As a specific example, the body 15 may be composed of a mixture of abrasive diamond particles dispersed in a matrix of sintered powdered metal, as is conventional. It will be obvious to those skilled in the art that the concentration of the abrasive particles effects the cutting and wearing properties of any particular cutting segment, and the concentration will be selected in accordance with the hardness of the material to be cut.

As shown in FIG. 3, the cutting segment 10 includes a substantially flat top wall 20 and a bottom wall 30 that is disposed opposite and parallel to the top wall. In use, the top wall comprises the cutting surface of the cutting segment, and the bottom wall provides a surface whereby the cutting segment can be attached to the circular steel disc. Additionally, the cutting segment has two opposite flat side walls 40 that lie parallel to each other and two opposite end walls 50 which define a longitudinal direction therebetween.

In the preferred embodiment, each end wall 50 has a recessed channel 51 that extends across the end wall and intersects the cutting surface and bottom wall. Each recessed channel is centered in its respective end wall and the channels are aligned relative to one another along the longitudinal direction. The intersection of the channels and the cutting surface defines a central portion 21 lying between the points of intersection of the channels and two remaining outer flanking portions 22 on opposite sides of the central portion and which are of longer longitudinal length than the central portion. In alternative embodiments, only one of the end walls has a recessed channel; those skilled in the art will appreciate that such an embodiment functions to provide a true cut in the same way as the preferred embodiment.

Figure 4:
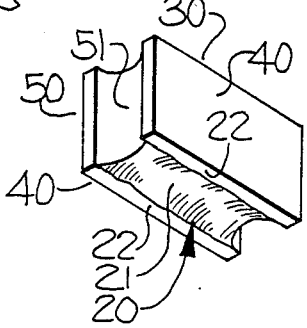
FIG. 4 is a perspective view of the cutting surface of a single cutting segment after a moderate amount of wearing has occurred.
Figure 5:
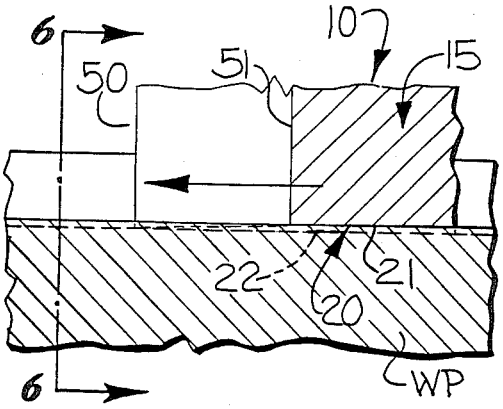
FIG. 5 is a elevational view in section of a grooved segment as it contacts a workpiece during usage.
Figure 6:
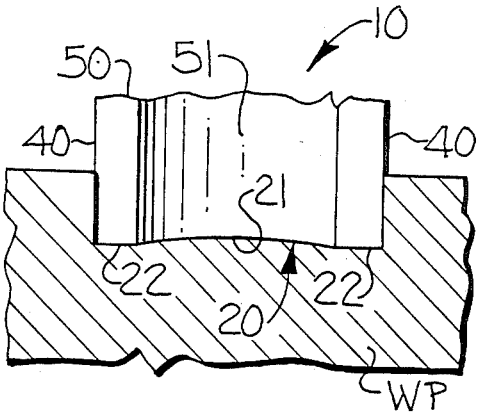
FIG. 6 is a sectional view through line 6—6 of FIG. 5 showing the leading end wall of the cutting segment.

As illustrated in FIGS. 4–6, when the cutting segment is mounted to a circular metal disc to form a circular cutting wheel and said cutting wheel is translated through stone or concrete, frictional wear occurs on the cutting surface that dissipates the metal comprising the portion of the segment that is the cutting surface. Because there is a greater longitudinal length along the flanking portions than along the central portion, the central portion wears more rapidly, and thus differential wearing occurs and a concave edge or arcuate groove, as illustrated in FIG. 4, is formed which extends longitudinally along the central portion between the channels 51. As shown in FIG. 5 and 6, the concave edge or arcuate groove results in a similar profile of opposite orientation being worn in the workpiece WP; the profile in the workpiece nests with the concave edge or arcuate groove of each successive cutting segment on the circular cutting wheel. In this way, each successive cutting segment follows the same path as the segments before it, and the circular cutting wheel moves through the workpiece in the desired true alignment.

The embodiment illustrated in FIGS. 1–6 shows the recessed channels as having cross sections that comprise about one half of a circle. As such, the minimum longitudinal length of the central portion is the length of the cutting surface less the diameter (twice the radius) of that circle. Also, the diameter of the circle defined by each channel 51 is more than one half the width W (FIG. 7) of the segment. It has been shown that the ratio of the minimum longitudinal length of the central portion to the length of the segment can be altered to customize a particular segment to different types of cutting requirements. Through experimental data, the ratio of the minimum longitudinal length to the length of the cutting surface can be determined to give the desired true cut and at the same time optimize the useful life of the grooved cutting segment. When cutting softer stone it is necessary to reduce the cutting segment's ability to resist wear along the central portion so that an operable groove develops; in such cases the ratio of the minimum longitudinal length to the length of the cutting surface would be less than for harder stone.

Figure 7:
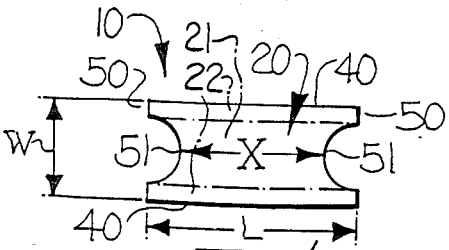
FIG. 7 is a top plan view of one embodiment of a cutting segment in accordance with the present invention and showing the cutting surface.

For instance, as shown in FIG. 7, in cutting blue granite it has been found that the ratio of the minimum longitudinal length to the length of the cutting surface (X/L) should be about 0.67 for a particular width (W) segment. Similarly, for white marble which is softer and less abrasive than blue granite, X/L should be about 0.60. Thus, for different values for the lengths (L) of the cutting segment, which is often dependent upon the size or type of the circular steel disc or the type of stone saw that the cutting wheel is adapted for, the appropriate geometry of the grooved cutting segment is easily determined.

Figure 8:
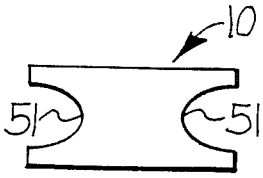
FIG. 8 is a top plan view of an alternative embodiment of the present invention wherein each channel has a cross section forming a portion of an ellipse.

In other embodiments, the recessed channels may have cross sections that comprise portions of a circle that are less than half the circle, or that comprise portions of an ellipse as illustraed in FIG. 8.

In the drawings and specification, there has been set forth a preferred embodiment of the invention, although specific terms are employed, they are used in a generic and descriptive sense only and not for the purpose of unduly limiting the scope of the present invention, which scope is defined by the appended claims.

What is claimed is:

1. A cutting segment adapted for mounting on the periphery of a cutting wheel that is used to cut stone, concrete and the like, said cutting segment comprising a unitary solid metallic body which includes a top wall defining a substantially planar cutting surface, a bottom wall opposite said cutting surface, two opposite flat side walls and two opposite end walls which are parallel to each other and perpendicular to said top wall and define a longitudinal direction therebetween, said end walls each including a recessed channel which extends between and intersects said cutting surface and bottom wall, said two channels each having an arcuate configuration and being centrally disposed in their respective end wall and aligned relative to one another, and thereby forming a central portion on said cutting surface lying between the points of intersection of said channels with the cutting surface, and two flanking portions along opposite sides of said central portion on said cutting surface and which are of greater longitudinal length than said central portion, whereby, a plurality of said cutting segments are adapted to be mounted about the periphery of a circular steel disc, with said cutting surface of each segment lying in a plane which is substantially tangential with respect to said circular steel disc, and such that greater wear occurs on the central portion of the cutting surface than the flanking portions resulting in inward wear of the central portion during use so as to form a groove which extends longitudinally along said central portion, and with said groove serving to guide the cutting wheel through the stone, concrete or the like and thereby providing a truer cut.

2. A cutting segment according to claim 1 wherein the said channels have a cross section that comprises a portion of a circle.

3. A cutting segment according to claim 2 wherein the said channels have a cross section that comprises about one half of a circle.

4. A cutting segment according to claim 1 wherein the said channels have a cross section that comprises a portion of an ellipse.

5. A cutting segment according to claim 1 wherein said unitary solid metallic body is comprised of a mixture of abrasive diamond particles in a matrix of sintered powdered metal.

6. A cutting wheel that is used to cut stone, concrete, or the like and that is adapted for mounting on a stone or concrete saw comprising:

a circular metal disc, and a plurality of cutting segments mounted on the periphery of the circular metal disc, each cutting segment comprising a unitary solid metallic body which includes a top wall defining a substantially planar cutting surface, a bottom wall opposite said cutting surface, two opposite flat side walls and two opposite end walls which are parallel to each other and perpendicular to said top wall and define a longitudinal direction therebetween, said end walls each including a recessed channel which extends between and intersects said cutting surface and bottom wall, said channels each having an arcuate configuration and being centrally disposed in their respective end wall and aligned relative to one another, and such that the cutting surfaces of each of the cutting segments lie in repsective planes which are substantially tangential with respect to said circular metal disc, and such that the cutting surface of each segment wears inwardly during use so as to form a groove which extends longitudinally along the cutting surface between the intersections of said channels and the cutting surface, and with the grooves of said segments collectively serving to guide the cutting wheel through the stone, concrete or the like and thereby providing a truer cut.

* * * * *